US006910515B2

(12) United States Patent
Nien

(10) Patent No.: US 6,910,515 B2
(45) Date of Patent: Jun. 28, 2005

(54) ELECTRICITY-OPERATED WINDOW BLIND

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/651,109

(22) Filed: Aug. 29, 2003

(65) Prior Publication Data

US 2005/0011615 A1 Jan. 20, 2005

(30) Foreign Application Priority Data

Jul. 16, 2003 (TW) ..... 92213028 U

(51) Int. Cl.[7] ..... E06B 9/26
(52) U.S. Cl. ..... 160/168.1 P; 160/176 R
(58) Field of Search ..... 160/168.1 P, 176 R, 160/188, DIG. 17; 318/480

(56) References Cited

U.S. PATENT DOCUMENTS 4,913,214 A * 4/1990 Ming ..... 160/168.1 P
5,444,339 A * 8/1995 Domel et al. ..... 318/17
5,760,558 A * 6/1998 Popat ..... 318/480
6,516,858 B1 * 2/2003 Anderson et al. ..... 160/168.1 P
6,598,652 B1 * 7/2003 Montesinos Alonso ..... 160/331
2002/0088561 A1 * 7/2002 Anderson et al. ..... 160/168.1 R
2002/0189768 A1 * 12/2002 Anderson et al. ..... 160/168.1 P
2004/0011477 A1 * 1/2004 Walker et al. ..... 160/168.1 P

* cited by examiner

*Primary Examiner*—Bruce A. Lev
(74) *Attorney, Agent, or Firm*—Browdy and Neimark, P.L.L.C.

(57) ABSTRACT

An electricity-operated window blind is constructed to include a headrail, a driving mechanism mounted inside the headrail and having a power input device for rotation upon receipt of power supply, and a power output device for synchronously rotating with the power input device, a bind body suspended below the headrail and coupled to the power output device and controlled by the power output device to change window shading status, and a control mechanism. The control mechanism includes a suspension rod downwardly suspended from the headrail by a first end thereof, and a controller installed in a second end of the suspension rod. The controller has a battery set electrically coupled to the power input device for providing the necessary working power to the power input device.

19 Claims, 5 Drawing Sheets

ELECTRICITY-OPERATED WINDOW BLIND

BACKGROUND OF THE INVENTION

1. Field of the Invention

The present invention relates generally to a window blind and, more specifically, to an electricity-operated window blind, which enables the user to replace the battery set conveniently and safely.

2. Description of the Related Art

A conventional electric window blind is generally comprised of a headrail fixedly located on the top side of the window, a blind body (slat assembly or curtain) suspended below the headrail, a motor drive mounted inside the headrail and coupled to the blind body, and a battery set installed in the headrail to provide the necessary working power to the motor drive, for enabling the motor drive to roll up or let off the blind down and to further change the window shading status.

Because the blind body is frequently opened and closed, the battery power of the battery set will be used up quickly. Further, due to limited space in the headrail, the sizes of the motor drive and the battery set (the output power of the motor drive and the storage volume of the battery set) are limited. Therefore, the battery set must be replaced with a new one when power low. However, because the battery set is installed in the headrail, which is located on the top side of the window (at a high place above the floor), the user may be not accessible to the battery set when standing on the floor. Therefore, when replacing the battery set, the user may need to use a ladder or stand means. However, it is dangerous to stand on a raised place when replacing the battery set, and the user may fall to the ground accidentally

SUMMARY OF THE INVENTION

The present invention has been accomplished under the circumstances in view. It is the main object of the present invention to provide an electricity-operated window blind, which enables the user to replace the battery set conveniently.

It is another object of the present invention to provide an electricity-operated window blind, which reduces the chance of the occurrence of an accident during replacement of the battery set.

To achieve these objects of the present invention, the electricity-operated window blind comprises a headrail, a driving mechanism mounted inside the headrail, a bind body suspended below the headrail, and a controller. The driving mechanism comprises a power input device for rotation upon receipt of power supply, and a power output device for synchronously rotating with the power input device. The bind body is coupled to the power output device and controlled by the power output device to change window shading status. The control mechanism comprises a suspension rod downwardly suspended from the headrail by a first end thereof, and a controller installed in a second end of the suspension rod. The controller has a battery set electrically coupled to the power input device for providing the necessary working power to the power input device.

DETAILED DESCRIPTION OF THE INVENTION

Figure 1:
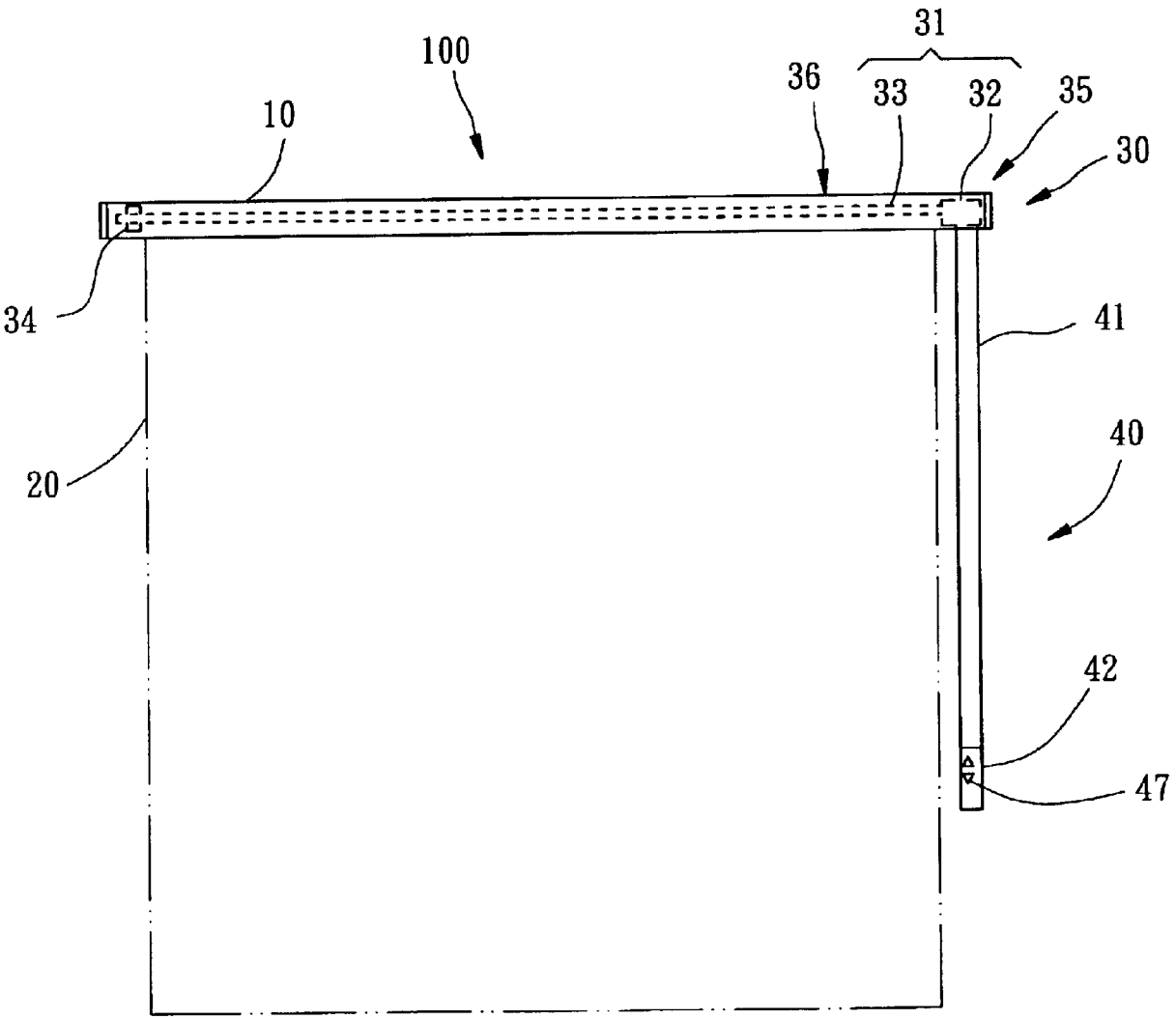
FIG. 1 is a schematic drawing showing the basic structural arrangement of an electricity-operated window blind according to the first preferred embodiment of the present invention.
Figure 2:
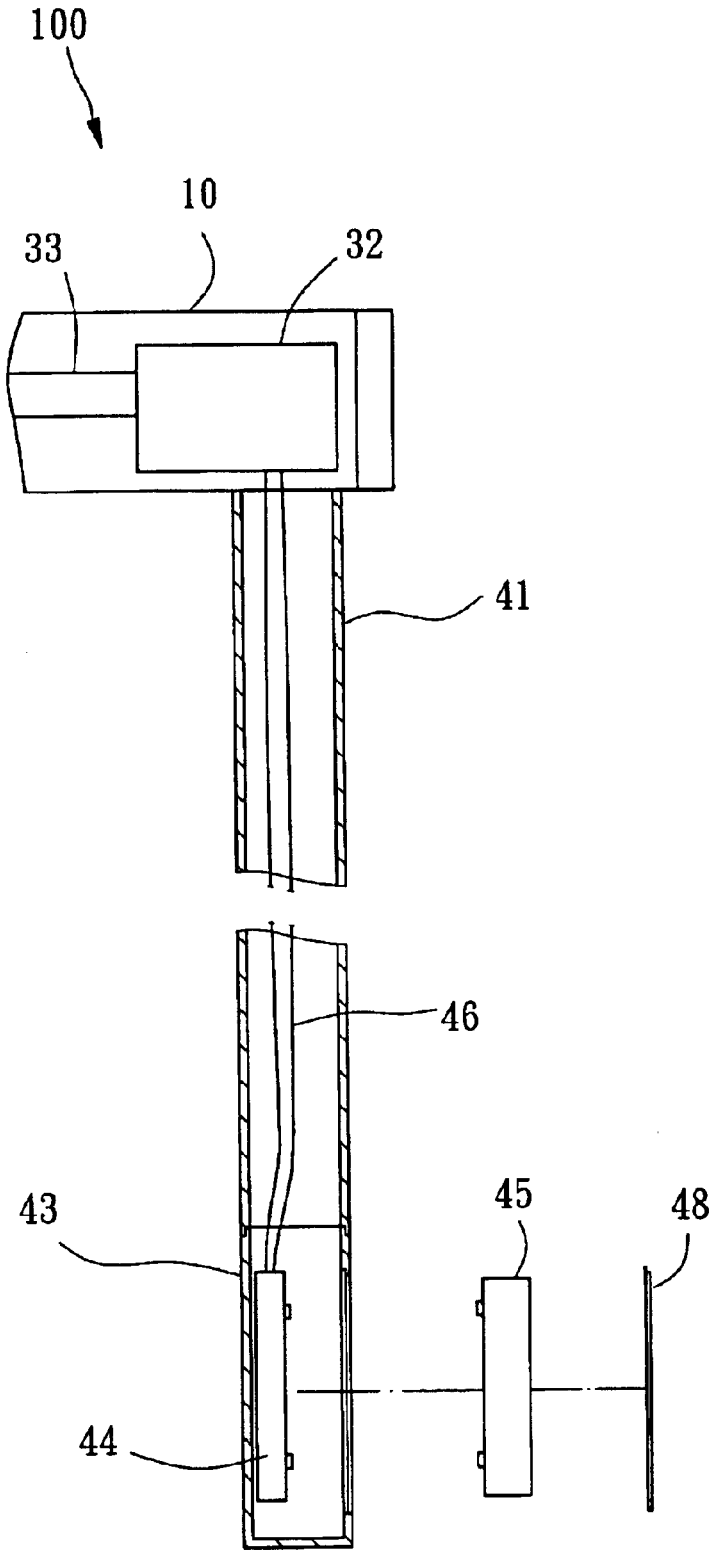
FIG. 2 is an exploded view in an enlarged scale of a part of the electricity-operated window blind shown in FIG. 1.

Referring to FIGS. 1 and 2, an electricity-operated window blind 100 in accordance with the first preferred embodiment of the present invention is shown comprised of a headrail 10, a blind body 20, a driving mechanism 30, and a control mechanism 40.

The headrail 10 is transversely (horizontally) affixed to the top side of the window (not shown), having an inside space of suitable volume.

The driving mechanism 30 comprises a motor drive 31. The motor drive 31 is comprised of a reversible motor 32 and an axle 33 coupled to the reversible motor 32. The reversible motor 32 is fixedly mounted in the inside space of the headrail 10 at the right side. The axle 33 is axially suspended in the headrail 10, having one end fixedly connected to the rotor (output shaft) of the reversible motor 32 and the other end pivoted to an axle holder 34 in the inside space of the headrail 10 at the left side.

The blind body 20 can be the slat assembly of a Venetian blind, the curtain of a window covering, or the like. According to this embodiment, the blind body 20 is a curtain having its top side fixedly connected in parallel to the periphery of the axle 33. When starting the driving mechanism 30 to rotate the axle 33, the axle 33 roll up/let off the blind body 20, i.e., the axle 33 moves the blind body 20 to change its shading status. Therefore, the axle 33 works as a power output device 36 that moves the blind body 20, and the reversible motor 32 works as a power input device 35 that moves the axle 33.

The control mechanism 40 comprises a hollow suspension rod 41 and a controller 42. The suspension rod 41 is vertically suspended from the headrail 10, having one end, namely, the top end fixedly connected to the headrail 10 corresponding to the reversible motor 32. The controller 42 comprises a handheld box 43 fixedly fastened to the other end, namely, the bottom end of the suspension rod 41 accessible to the hand of a person. As shown in FIG. 2, the handheld box 43 houses a circuit board 44, which controls rotation (forward/backward rotation) and stoppage of the reversible motor 32, and a battery set 45 electrically coupled to the circuit board 44. The circuit board 44 has power input contacts (not shown). The battery set 45 has power output contacts (not shown). When inserted the battery set 45 into the handheld box 43, the power output contacts of the battery set 45 are respectively maintained in contact with the power input contacts of the circuit board 44, and therefore battery power is linked to the circuit board 44. Lead wires 46 are inserted through the suspension rod 41 and electrically connected between the circuit board 44 and the reversible motor 32. The handheld box 43 has control switches 47 located on the outside for controlling the operation mode of the circuit board 44, and a detachable battery lid 48 corresponding to the battery set 45. When detached the battery lid 48 from the handheld box 43, the battery set 45 can easily be removed from the handheld box 43 for a replacement.

After detailed description of the structure and relative positioning of the parts of the first embodiment of the present invention, the operation of the electricity-operated window blind 100 is outlined hereinafter.

When wishing to change the shading status of the blind body 20, the user can directly operate the control switches 47 of the controller 42 to rotate the reversible motor 32 forwards or backwards, or to stop the reversible motor 32, thereby causing the shading status of the blind body 20 to be relatively changed. When the power of the battery set 45 of the controller 42 used up, the user can then open the battery lid 48 and then replace the battery set 45. After installation of a new battery set, the battery lid 48 is closed again.

Because the suspension rod 41 holds the controller 42 at an elevation accessible to the hand of a person, the user can conveniently operate the controller 42 to control the shading status of the blind body 20. When battery low, the user can conveniently replace the battery set 45.

Figure 3:
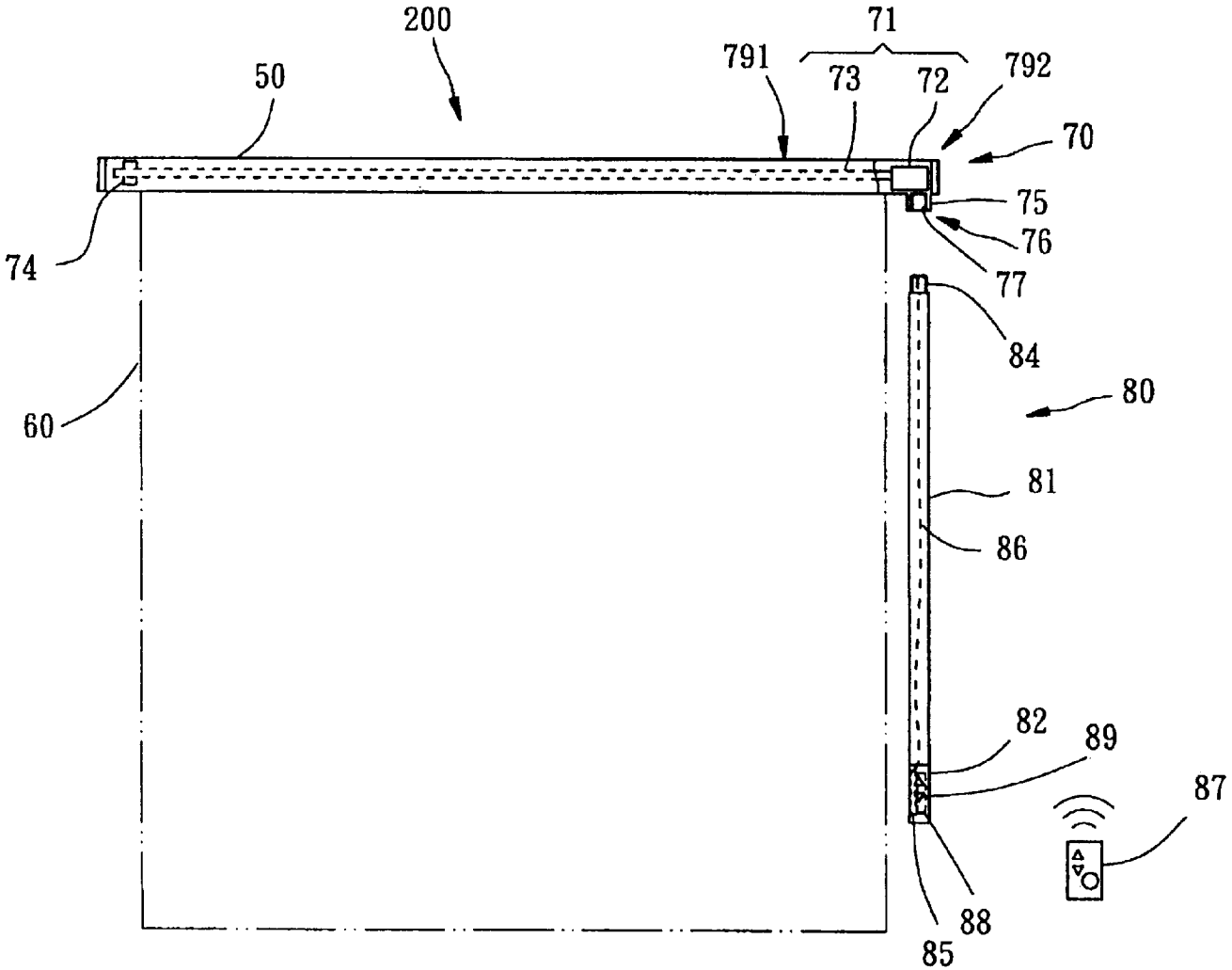
FIG. 3 is a schematic drawing showing the basic structural arrangement of an electricity-operated window blind according to the second preferred embodiment of the present invention.
Figure 4:
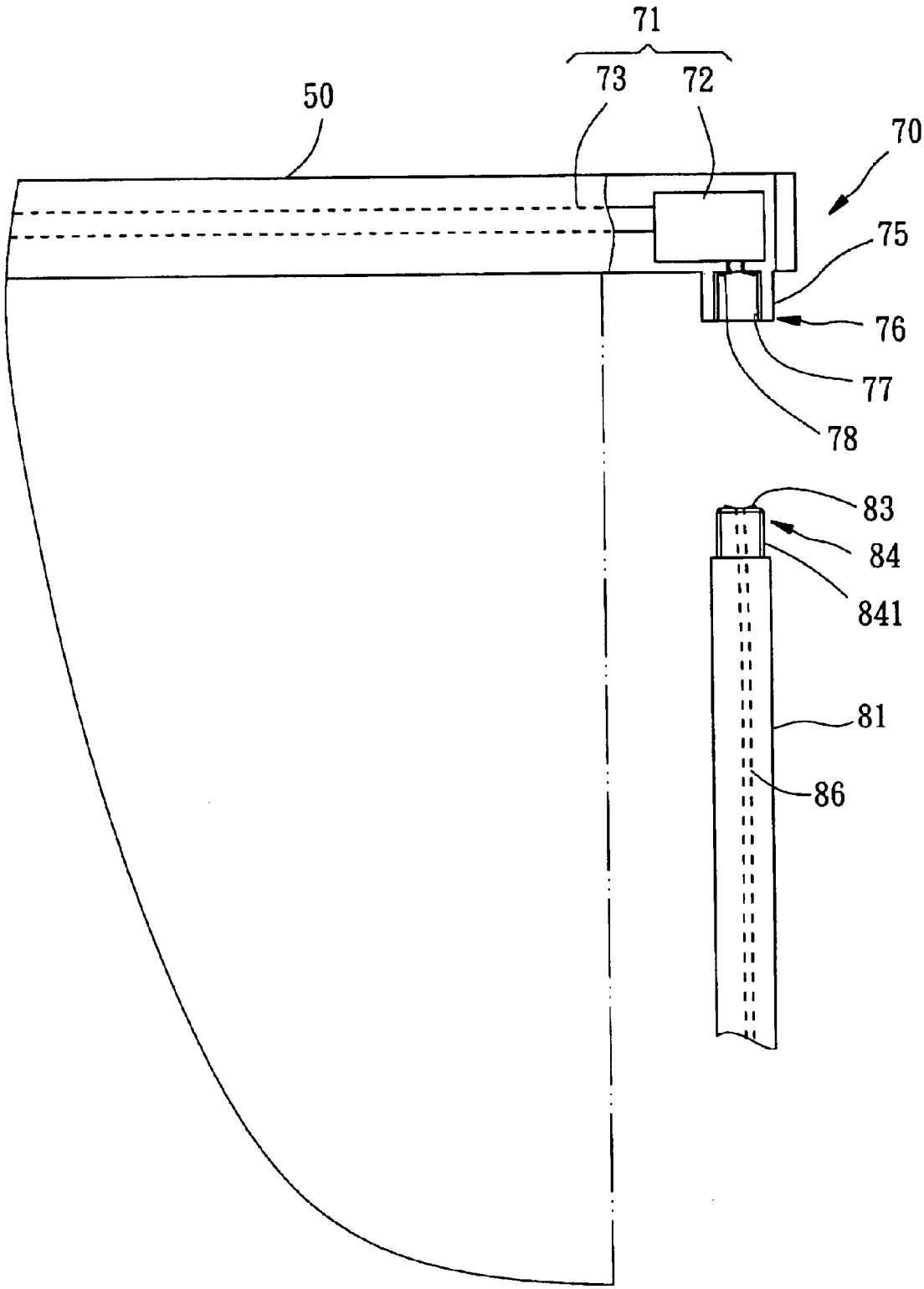
FIG. 4 is an exploded view in an enlarged scale of a part of the electricity-operated window blind shown in FIG. 3.

FIGS. 3 and 4 show an electricity-operated window blind 200 constructed according to the second preferred embodiment of the present invention. According to this embodiment, the electricity-operated window blind 200 comprises a headrail 50, a blind body 60, a driving mechanism 70, and a control mechanism 80. The headrail 50 and the blind body 60 are substantially similar to the like members in the aforesaid first embodiment. The main features of this second embodiment are outlined hereinafter.

The driving mechanism 70 comprises a motor drive 71 and a coupling device 75. The motor drive 71 comprises a reversible motor 72 installed in the right side inside the headrail 50, and an axle 73 coupled to the rotor (output shaft) of the reversible motor 72 and pivotally supported in an axle holder 74 in the left side inside the headrail 50. The coupling device 75 is made of electrically insulative material and fixedly fastened to the headrail 50, having a part extended out of the right bottom side of the headrail 50. The coupling device 75 comprises connecting means 76 and terminals 78. According to this embodiment, the connecting means 76 is an inner thread 77. The terminals 78 are located on the top side of the coupling device 75, and electrically coupled to the reversible motor 72. According to this embodiment, the axle 73 works as a power output device 791, and the reversible motor 72 and the coupling device 75 form a power input device 792 adapted to receive electric energy and to rotate the power output device 791.

The control mechanism 80 comprises a hollow suspension rod 81 and a controller 82. The suspension rod 81 is a hollow rod member of a predetermined length, having one end connected to the controller 82 and the other end provided with terminals 83. The suspension rod 81 has coupling means 84. According to this embodiment, the coupling means 84 is an outer thread 841 extended around the periphery of the end where the terminals 83 are provided. The outer thread 841 can be threaded into the inner thread 77 to force the terminals 83 into contact with the terminals 78. Lead wires 86 are inserted into the suspension rod 81 and electrically connected between the terminals 83 and the circuit board 85 of the controller 82. The circuit board 85 has a wireless receiving circuit adapted to receive control signal from a remote controller 87.

When in use, the outer thread 841 of the suspension rod 81 is threaded into the inner thread 77 of the coupling device 75 to force the terminals 83 into contact with the terminals 78, thereby causing the reversible motor 72 to be electrically coupled to the circuit board 85, i.e., the terminals 78 of the coupling device 75 and the terminals 83 of the suspension rod 81 form a first interface and a second interface between the battery set 88 of the controller 82 and the reversible motor 72, for enabling battery power supply to be provided by the battery set 88 to the reversible motor 72. The user may operate the control switches 89 of the controller 82 to drive the circuit board 85 to start/stop the reversible motor 72. Alternatively, the user can directly use the remote controller 87 to control the operation of the circuit board 85 at a remote place.

Further, when the blind body 60 moved to the desired position, the user can then disconnect the suspension rod 81 from the coupling device 74 and have the control mechanism 80 separately stored in a storage place, keeping the outer appearance of the window blind neat and clean.

Figure 5:
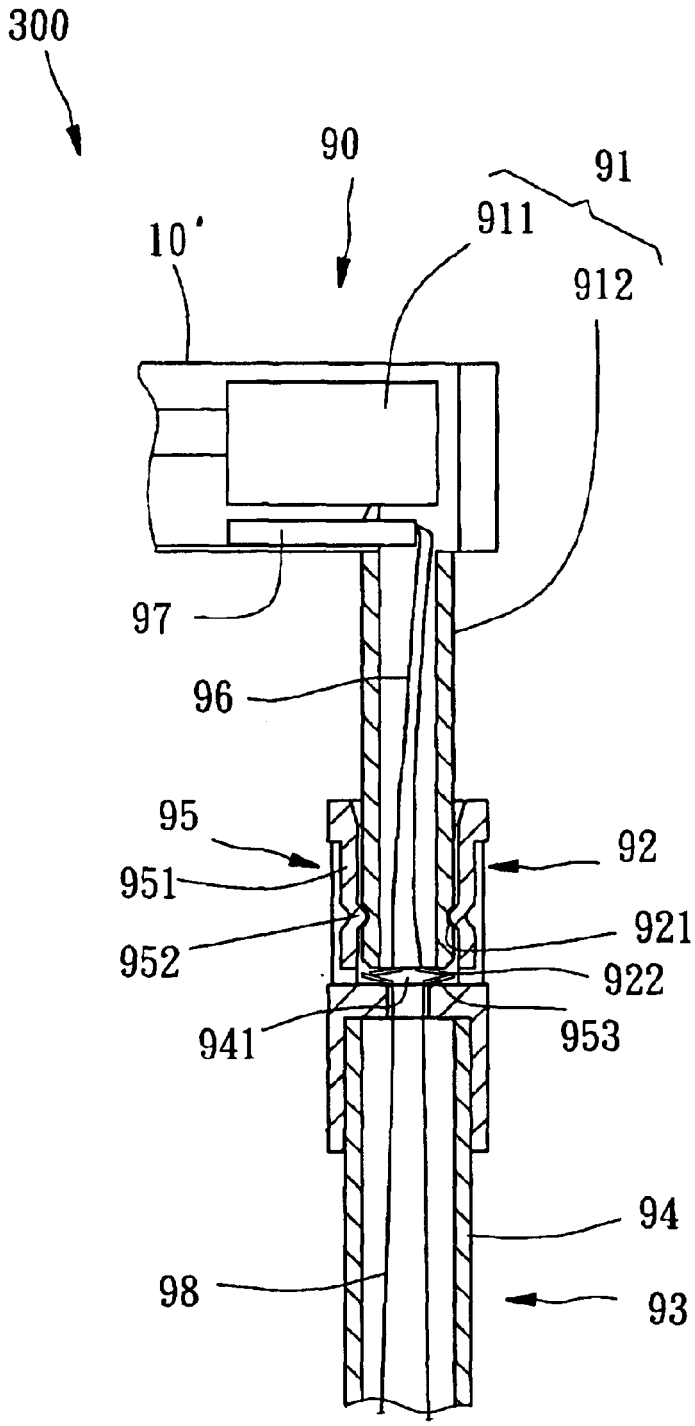
FIG. 5 is a schematic partial view in section of an electricity-operated window blind according to the third preferred embodiment of the present invention.

FIG. 5 shows an electricity-operated window blind 300 constructed according to the third preferred embodiment of the present invention. This embodiment is substantially similar to the aforesaid second embodiment of the present invention with exceptions outlined hereinafter.

The power input device 91 of the driving mechanism 90 is formed of a reversible motor 911 and a hexagonal rod member 912, which serve as the input device 91. The reversible motor 911 is mounted inside the headrail 10'. The hexagonal rod member 912 is installed in the headrail 10', having a bottom side extended out of the headrail 10' toward the operation position of the user and a coupling portion 92, for example, a V-groove 921 extended around the periphery near the bottom side, and a plurality of contacts 922 in the bottom edge of the bottom side.

The suspension rod 94 of the control mechanism 93 has a hexagonal coupling hole 941 in the top end, and retaining means 95 in the hexagonal coupling hole 941. According to this embodiment, the retaining means 95 comprises a plurality of spring strips 951 vertically located on the peripheral wall of the hexagonal coupling hole 941, each having a smoothly arched protruding portion 952 projecting toward the central axis of the hexagonal coupling hole 941. The suspension rod 94 further has a plurality of terminals 953 respectively installed in the hexagonal coupling hole 941 and electrically connected to the battery set (not shown) of the controller (not shown) by lead wires 98. The circuit board 97 of the controller is mounted inside the headrail 10' and electrically connected to the reversible motor 911. Lead wires 96 are inserted through the power input device 91 to electrically connect the circuit board 97 to the contacts 922.

When in use, the user lift the suspension rod 94 to force the hexagonal coupling hole 941 into engagement with the power input device 91 of the driving mechanism 90. At this time, the smoothly arched protruding portions 952 of the spring strips 951 are respectively forced into engagement with the V-groove 921, keeping the suspension rod 94 firmly connected to the power input device 91. At this time, the contacts 922 of the hexagonal rod member 912 are maintained in contact with the terminals 953 in the hexagonal coupling hole 941, for enabling battery power supply to be transmitted from the controller through the lead wires 98, 96 to the circuit board 97 and then the reversible motor 911. Further, because the spring strips 951 are deformable, the user can employ a force to the suspension rod 94, keeping the suspension rod 94 connected to or disconnected from the power input device 91.

What is claimed is:

1. An electricity-operated window blind comprising:

a headrail;

a driving mechanism mounted inside said headrail and having a power input device for rotating upon receipt of power supply, and a power output device for rotating with said power input device;

a blind body suspended below said headrail and coupled to said power output device and controlled by said power output device to change window shading status;

a control mechanism having a suspension rod downwardly suspended from said headrail by a first end thereof, and a controller installed in a second end of said suspension rod, said controller having a battery set electrically coupled to said power input device for providing the necessary working power to said power input device; and wherein said power input device comprises a motor and a coupling device, the coupling device of said power input device having connecting means, and first electric interfacing means installed in said connecting means for receiving external electricity and transferring received external electricity to said motor; said suspension rod comprises coupling means detachably coupled to the connecting means of the coupling device of said power input device, and second electric interfacing means located on the coupling means of said suspension rod and electrically connected to said battery set of said controller and adapted to match said first electric interfacing means for transmission of electricity from said battery set to said motor upon connection of said suspension rod to the coupling device of said power input device.

2. The electricity-operated window blind as claimed in claim 1, wherein said power input device comprises a motor; said power output device comprises an axle coupled to said motor for synchronous rotation.

3. The electricity-operated window blind as claimed in claim 1, wherein the connecting means of the coupling device of said power input device is an inner thread, and the coupling means of said suspension rod is an outer thread adapted to thread into the inner thread of the connecting means of the coupling device of said power input device.

4. The electricity-operated window blind as claimed in claim 1, wherein said first electric interfacing means is comprised of a plurality of terminals electrically connected to said motor by lead wires; said second electric interfacing means is comprised of a plurality of terminals electrically connected to said battery set.

5. The electricity-operated window blind as claimed in claim 1, wherein said power input device is comprised of a motor mounted inside said headrail, and a hexagonal rod member mounted in said headrail and partially extended out of said headrail, said hexagonal rod member having a coupling portion and a plurality of contacts disposed in a bottom side thereof and electrically connected to said motor; said suspension rod comprises a hexagonal coupling hole formed in said first end for receiving the hexagonal rod member of said power input device, retaining means disposed in said hexagonal coupling hole for securing said suspension rod to the hexagonal rod member of said power input device, and a plurality of terminals installed in said hexagonal coupling hole and electrically connected to said battery set for contacting the contacts of said hexagonal rod member for transmission of electricity from said battery set to said motor.

6. The electricity-operated window blind as claimed in claim 5, wherein said coupling portion of said hexagonal rod member is a V-groove extended around a periphery of said hexagonal rod member; said retaining means is comprised of a plurality of spring strips vertically disposed in a periphery of said hexagonal coupling hole of said suspension rod, said spring strips each having a smoothly arched protruding portion projecting toward a central axis of said hexagonal coupling hole and adapted to engage the V-groove of said coupling portion of said hexagonal rod member.

7. The electricity-operated window blind as claimed in claim 1, wherein said suspension rod is a hollow rod member having a predetermined length, and lead wires mounted therein for transmitting electricity from said battery set to said power input device.

8. The electricity-operated window blind as claimed in claim 1, wherein said controller comprises a handheld box fixedly connected to said suspension rod, a circuit board mounted inside said handheld box for controlling the operation of said motor, said battery set electrically connected to said circuit board, and control switches located on an outside of said handheld box for controlling the operation of said circuit board.

9. The electricity-operated window blind as claimed in claim 8, wherein said handheld box comprises a detachable battery lid corresponding to said battery set.

10. The electricity-operated window blind as claimed in claim 8, wherein said circuit board comprises a wireless receiving circuit for receiving control signal from a remote controller.

11. An electricity-operated window blind comprising:

a headrail;

a driving mechanism mounted inside said headrail and having a power input device for rotating upon receipt of power supply, and a power output device for rotating with said power input device;

a blind body suspended below said headrail and coupled to said power output device and controlled by said power output device to change window shading status;

a control mechanism having a suspension rod downwardly suspended from said headrail by a first end thereof, and a controller installed in a second end of said suspension rod, said controller having a battery set electrically coupled to said power input device for providing the necessary working power to said power input device;

wherein said power input device is comprised of a motor mounted inside said headrail, and a hexagonal rod member mounted in said headrail and partially extended out of said headrail, said hexagonal rod member having a coupling portion and a plurality of contacts disposed in a bottom side thereof and electrically connected to said motor; said suspension rod comprises a hexagonal coupling hole formed in said first end for receiving the hexagonal rod member of said power input device, retaining means disposed in said hexagonal coupling hole for securing said suspension rod to the hexagonal rod member of said power input device, and a plurality of terminals installed in said hexagonal coupling hole and electrically connected to said battery set for contacting the contacts of said hexagonal rod member for transmission of electricity from said battery set to said motor; and wherein said coupling portion of said hexagonal rod member is a V-groove extended around a periphery of said hexagonal rod member; said retaining means is comprised of a plurality of spring strips vertically disposed in a periphery of said hexagonal coupling hole of said suspension rod, said spring strips each having a smoothly arched protruding portion projecting toward a central axis of said hexagonal coupling hole and adapted to engage the V-groove of said coupling portion of said hexagonal rod member.

12. The electricity-operated window-blind as claimed in claim 11, wherein said power input device comprises a motor; said power output device comprises an axle coupled to said motor for synchronous rotation.

13. The electricity-operated window blind as claimed in claim 11, wherein said power input device comprises a motor and a coupling device, the coupling device of said power input device having connecting means, and first electric interfacing means installed in said connecting means for receiving external electricity and transferring received external electricity to said motor; said suspension rod comprises coupling means detachably coupled to the connecting means of the coupling device of said power input device, and second electric interfacing means located on the coupling means of said suspension rod and electrically connected to said battery set of said controller and adapted to match said first electric interfacing means for transmission of electricity from said battery set to said motor upon connection of said suspension rod to the coupling device of said power input device.

14. The electricity-operated window blind as claimed in claim 13, wherein the connecting means of the coupling device of said power input device is an inner thread, and the coupling means of said suspension rod is an outer thread adapted to thread into the inner thread of the connecting means of the coupling device of said power input device.

15. The electricity-operated window blind as claimed in claim 13, wherein said first electric interfacing means is comprised of a plurality of terminals electrically connected to said motor by lead wires; said second electric interfacing means is comprised of a plurality of terminals electrically connected to said battery set.

16. The electricity-operated window blind as claimed in claim 11, wherein said suspension rod is a hollow rod member having a predetermined length, and lead wires mounted therein for transmitting electricity from said battery set to said power input device.

17. The electricity-operated window blind as claimed in claim 11, wherein said controller comprises a handheld box fixedly connected to said suspension rod, a circuit board mounted inside said handheld box for controlling the operation of said motor, said battery set electrically connected to said circuit board, and control switches located on an outside of said handheld box for controlling the operation of said circuit board.

18. The electricity-operated window blind as claimed in claim 17, wherein said handheld box comprises a detachable battery lid corresponding to said battery set.

19. The electricity-operated window blind as claimed in claim 17, wherein said circuit board comprises a wireless receiving circuit for receiving control signal from a remote controller.

* * * * *